US007004237B2

(12) United States Patent
Mathur et al.

(10) Patent No.: US 7,004,237 B2
(45) Date of Patent: Feb. 28, 2006

(54) SHELL AND PLATE HEAT EXCHANGER

(75) Inventors: Achint P. Mathur, Wichita Falls, TX (US); Jason Michael Fulmer, Wichita Falls, TX (US)

(73) Assignee: Delaware Capital Formation, Inc., Wilmington, DE (US)

( * ) Notice: Subject to any disclaimer, the term of this patent is extended or adjusted under 35 U.S.C. 154(b) by 281 days.

(21) Appl. No.: 10/044,870

(22) Filed: Jan. 10, 2002

(65) Prior Publication Data

US 2003/0000688 A1 Jan. 2, 2003

Related U.S. Application Data

(60) Provisional application No. 60/302,050, filed on Jun. 29, 2001.

(51) Int. Cl.
*F28F 7/00* (2006.01)
*F28F 3/08* (2006.01)

(52) U.S. Cl. ..... 165/82; 165/167

(58) Field of Classification Search ..... 165/81, 165/82, 83, 167, 166
See application file for complete search history.

(56) References Cited

U.S. PATENT DOCUMENTS 4,732,713 A 3/1988 Korsell
5,078,209 A * 1/1992 Kerkman et al. ..... 165/167
5,088,552 A * 2/1992 Raunio ..... 165/166
5,146,980 A * 9/1992 Le Gauyer ..... 165/167
5,327,958 A 7/1994 Machata et al.
5,823,253 A * 10/1998 Kontu ..... 165/167
5,832,736 A * 11/1998 Yoshioka et al. ..... 165/167
6,016,865 A 1/2000 Blomgren
6,131,646 A * 10/2000 Kelley ..... 165/81
6,131,648 A 10/2000 Rasmussen
6,474,408 B1 * 11/2002 Yeh et al. ..... 165/82

FOREIGN PATENT DOCUMENTS

WO WO 97/45689 12/1997
WO WO/99/30099 6/1999

* cited by examiner

*Primary Examiner*—Ljiljana Ciric
(74) *Attorney, Agent, or Firm*—Reising, Ethington, Barnes, Kisselle, P.C.

(57) ABSTRACT

A pair of round corrugated heat transfer plates provide a cassette with the corrugations of one heat exchanger plate angled relative to the other so as to form channels for fluid flow of a primary fluid and a secondary fluid. A plurality of the cassettes are contained within a housing and have a pair of port holes. The housing has a cylindrical shell, a bottom cover and a top cover. The shell has an inlet nozzle and an outlet nozzle for the secondary fluid. The top cover has an inlet nozzle and an outlet nozzle for a primary fluid. The nozzles are aligned with the port holes. A spring device compensates for any mechanical or thermal expansion of the cassettes. A prevents short-circuiting of the fluid.

19 Claims, 8 Drawing Sheets

SHELL AND PLATE HEAT EXCHANGER

This invention is based on Provisional U.S. patent application Ser. No. 60/302,050 filed on Jun. 29, 2001 and entitled Shell and Plate Heat Exchanger. The invention relates to heat exchangers and refers more particularly to enclosed, all gasketed, partially gasketed (semi-welded), or all welded plate heat exchangers.

FIELD OF THE INVENTION

The present invention relates to a heat exchanger for exchanging heat between two fluids. The heat exchanger comprises a pack of corrugated heat transfer plates which are provided with inlet and outlet ports for a primary fluid that lead to channels formed by the corrugations in the plates for fluid flow therethrough. The heat transfer plates are paired together so as to provide for separate inlet and outlet channels for the fluid flow of primary and secondary fluids within the heat exchanger cylindrical housing. The secondary fluid communicates in direct heat transfer by flowing through channels around the primary fluid inlet and outlet ports, whereas the primary fluid communicates in indirect heat transfer by flowing through alternate channels and between the inlet and outlet ports. Gaskets or welding provide the sealing methods necessary to contain and separate the primary and secondary fluids. A spring device is provided at the bottom of the heat exchanger housing to compensate for any expansion of the heat transfer plates along the longitudinal axis of the housing. In addition, seal means are provided within the housing for preventing short circuiting of the secondary fluid as it flows through the heat exchanger.

Depending on the type of service, the invention may be configured with gaskets and/or welding in one of the four different configurations. For example:

(a) a semi-welded heat exchanger with gaskets sealing the port areas of the plates, and welds sealing the plate perimeter;

(b) an all gasketed heat exchanger with gaskets sealing the port areas and the plate perimeter;

(c) a semi-welded heat exchanger in which welds are used to seal the port areas between plate channels, and gaskets are used to seal the plate perimeter; and (d) an all-welded heat exchanger in which welds are used to seal the port areas between plate channels, and welds are likewise used to seal the plate perimeter.

DETAILED DESCRIPTION OF THE INVENTION

Figure 1:
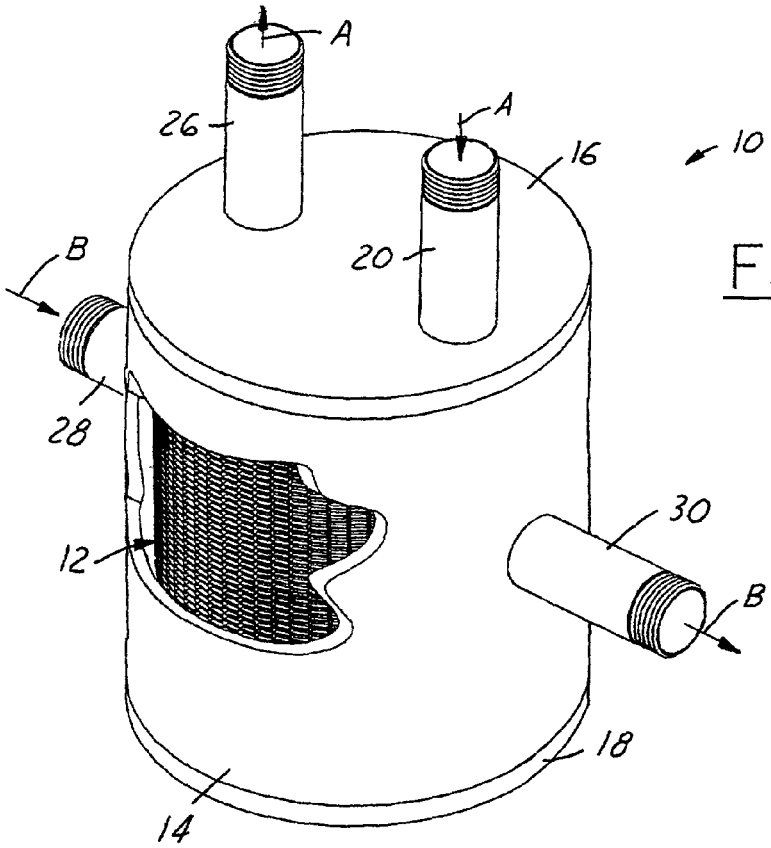
FIG. 1 is an isometric view of the external details of one version of a heat exchanger with a cut away section showing the internal heat transfer plate pack.
Figure 2:
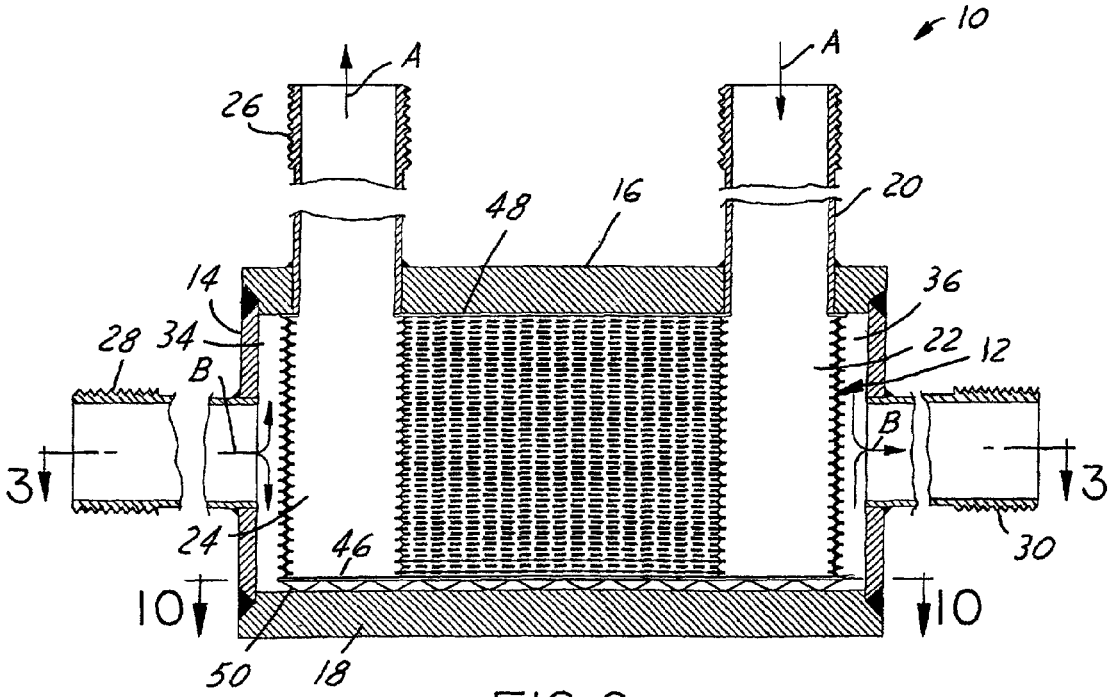
FIG. 2 is a cross-sectional view of the heat exchanger seen in FIG. 1.

Referring to the drawing and more particularly FIG. 1 thereof, the external features are shown of one version of a heat exchanger 10 made in accordance with the present invention. As seen in FIGS. 1 and 2, the heat exchanger 10 comprises a series of cassettes 12 enclosed within a housing comprising a cylindrical shell 14 the upper portion of which is closed by a circular top cover member 16 and the lower portion of which is closed by a circular bottom cover member 18. The top cover member 16 includes an inlet nozzle 20 adapted to receive primary fluid at a predetermined temperature. The primary fluid flows in the direction of the arrow "A" entering the heat exchanger 10 through the inlet nozzle 20 and then into an inlet port 22 formed in each of the cassettes 12. The primary fluid then flows through alternating channels or passages (shown in FIG. 9) and through an outlet port 24 formed in each of the cassettes 12 and finally exits though an outlet nozzle 26 secured to the top cover member 16.

As seen in FIGS. 1 and 2, the secondary fluid flows in the direction of the arrows "B" entering the shell side of the heat exchanger 10 through a shell side inlet nozzle 28 and exists through a shell side outlet nozzle 30. The secondary fluid flows into a circular area surrounding the cassettes 12 that is divided by a pair of metal identical seals 32 into a secondary fluid inlet chamber 34 and a secondary fluid outlet chamber 36. The seals 32, as seen in FIGS. 3 and 4, are positioned along an axis which is substantially normal to an axis passing through the longitudinal centers of the nozzles 28 and 30.

Figure 3:
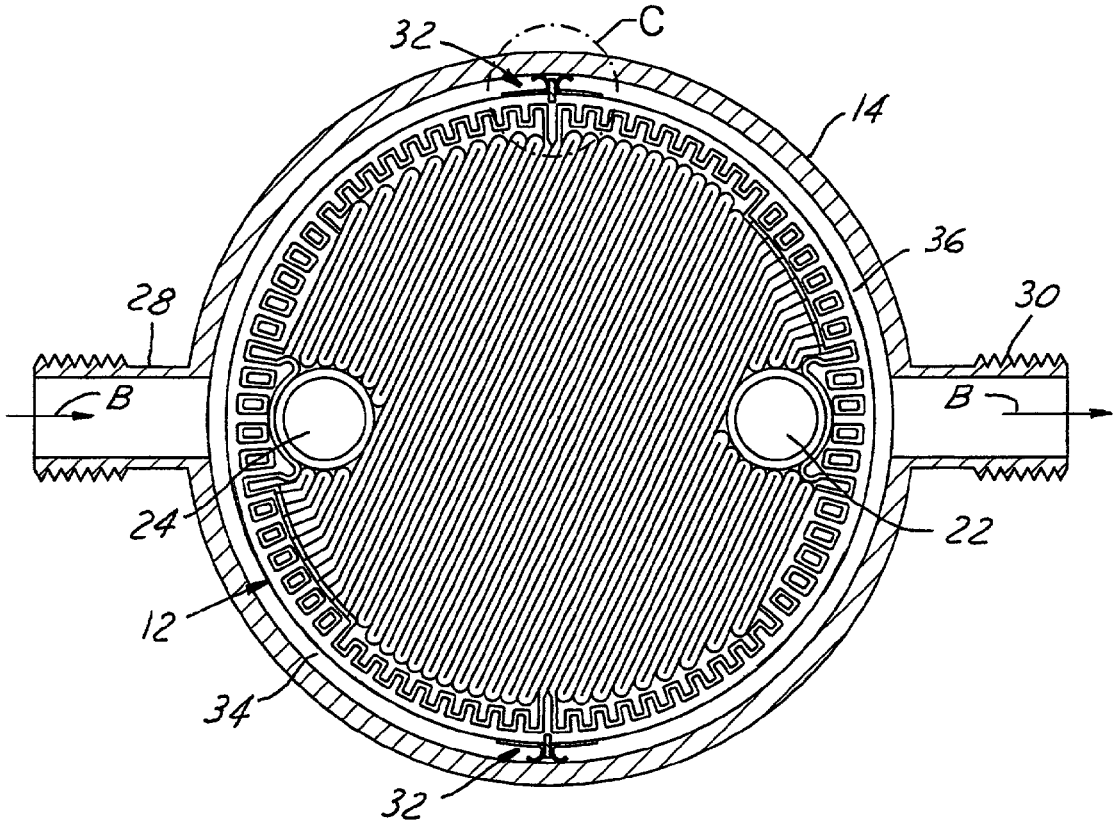
FIG. 3 is a sectional view taken on line 3—3 of FIG. 2.
Figure 4:
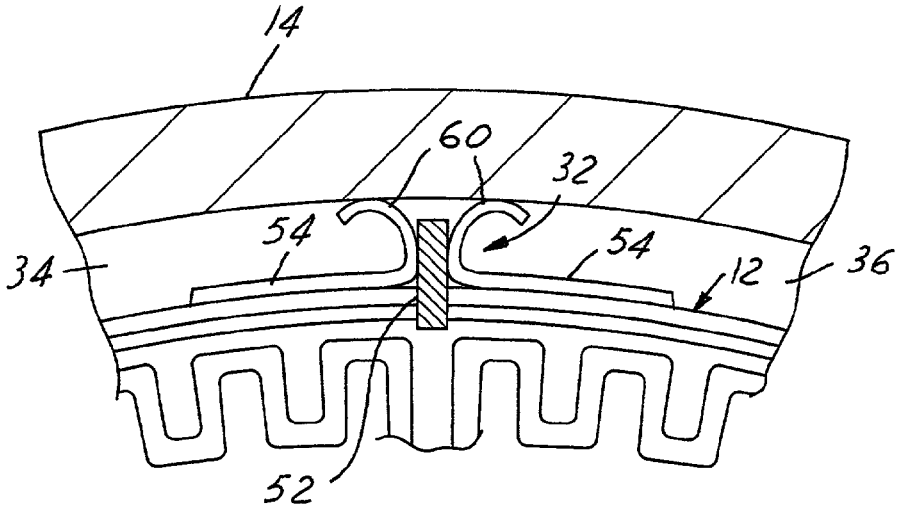
FIG. 4 is an enlarged view of one of the two diametrically opposed seals indicated by the letter "C" in FIG. 3.
Figure 9:
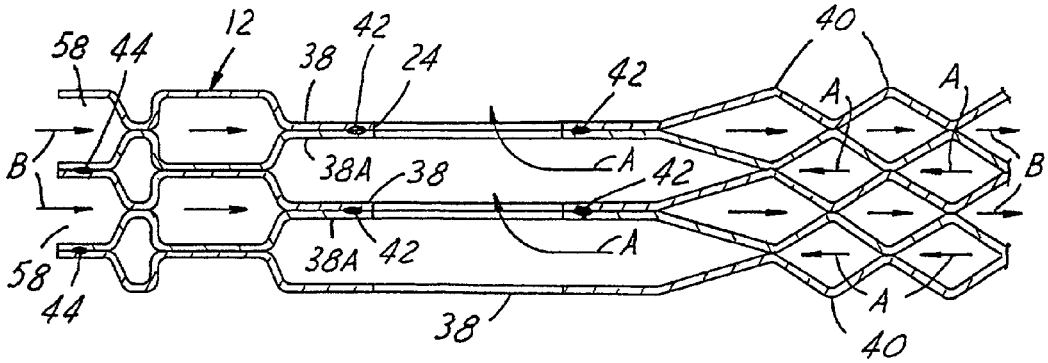
FIG. 9 is an enlarged sectional view of the stacked cassettes taken on line 9—9 of FIG. 8.

The secondary fluid initially flows into the arcuate inlet chamber 34 formed by the pair of diametrically opposed seals 32 seen in FIGS. 3 and 4. The seals 32 force the secondary fluid to flow from chamber 34 through alternate channels or passages located in each of the cassettes 12 into chamber 36. As seen in FIG. 9, each of the channels through which the secondary fluid flows are located between the channels provided for the primary fluid. The secondary fluid flows in the direction of arrows "B" around the ports 22 and 24 and into the chamber 36 and then exits the heat exchanger 10 through the outlet nozzle 30. As should be apparent, the seals 32 prevent short circuit flow between the inlet and outlet shell side nozzles 28 and 30.

At this juncture, it will be noted that the top and bottom cover members 16 and 18 are joined to the cylindrical shell 14 by welding or other convenient means that would prevent leakage of internal fluids to the external surroundings. Similarly, the primary fluid inlet and outlet port nozzles 20 and 26 are joined to the top cover member 16 by welds, and the secondary fluid inlet and outlet nozzles 28 and 30 are joined by welds to the cylindrical shell 14.

Figure 5:
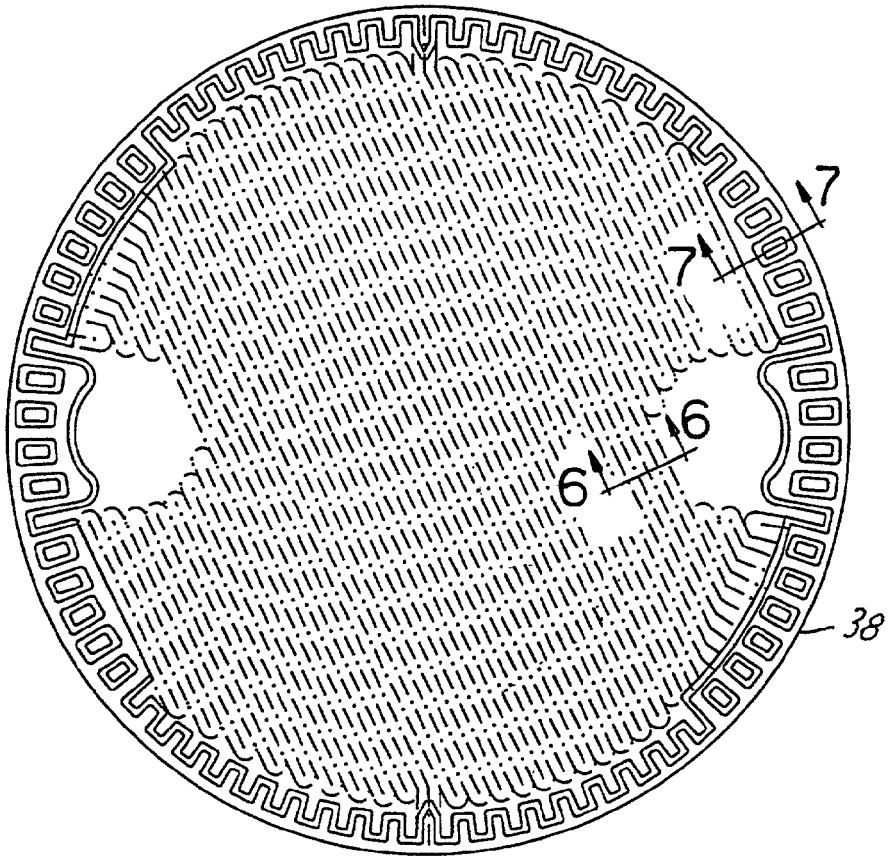
FIG. 5 is an enlarged view of one of the heat transfer plates located in the heat exchanger of FIGS. 1–4 and prior to the formation of the ports therein.
Figure 6:
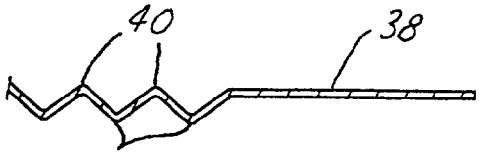
FIGS. 6 and 7 are enlarged sectional views taken respectively on line 6—6 and line 7—7 of FIG. 5.
Figure 7:
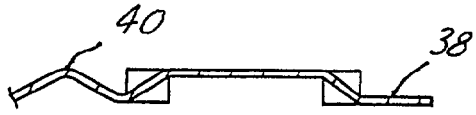
Figure 8:
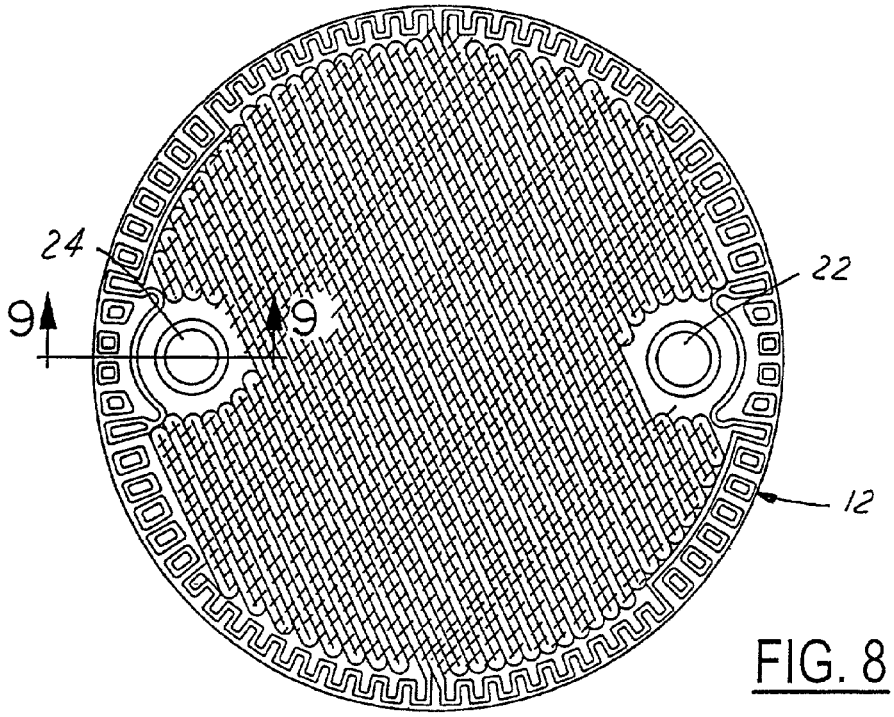
FIG. 8 is an enlarged top view of at least two stacked cassettes of the type located in the heat exchanger of FIGS. 1–4.

As seen in FIGS. 8 and 9, each cassette 12 consists of a pair of heat transfer ("HT") plates 38 and 38*a*. One of the HT plates 38 is shown in FIG. 5 having the configuration it assumes prior to having the holes required for inlet port 22 and the outlet port 24 formed therein. As seen in FIG. 6, the HT plate 38 has a plurality of generally "V" shaped and parallel channels formed therein each of which has inner and outer ridges each identified by reference numeral 40. It will be understood that the HT plate 38*a* is identical in configuration to the HT plate 38. After a pair of the HT plates 38, 38*a* are formed and holes for the inlet and outlet ports 22 and 24 are provided in each of the plates, one of the HT plates 38 or 38*a* is rotated 180 degrees and turned over so that one of the plates 38 or 38*a* is superimposed upon the other. This causes the channels of each of the plates to cross each other at a fixed angle as seen in FIG. 8 wherein several of the channels of the HT plate 38*a* are shown in phantom lines. After the HT plates 38 and 38*a* are superimposed in this manner, the two plates form a cassette 12 having passages therein formed by the inner ridges of the channels. The HT plates 38 and 38*a* are then connected to each other by providing a circular weld 42 just outside of each of the inlet and outlet ports 22 and 24. The weld 42 provides a seal between the two plates 38 and 38*a* around each of the associated ports. Afterwards, two of the cassettes 12 are stacked on top of each other and attached to each other by providing a seal in the form of a continuous weld 44 adjacent the outside perimeter of the two inner plates 38 and 38*a* as seen in FIG. 9. Another cassette 12 is then placed on top of the two-cassette packet and similarly attached to each other. This continues until the desired number of cassettes 12 are joined to each other.

Figure 10:
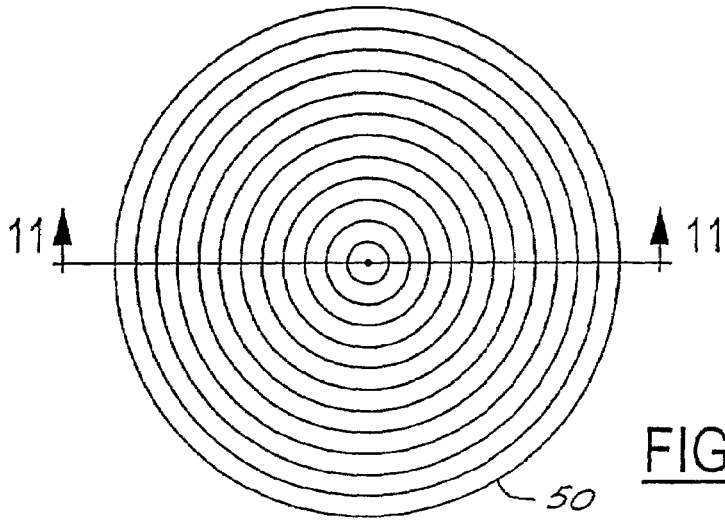
FIG. 10 is a top view of the spring device taken on line 10—10 of the heat exchanger seen in FIG. 2.
Figure 11:
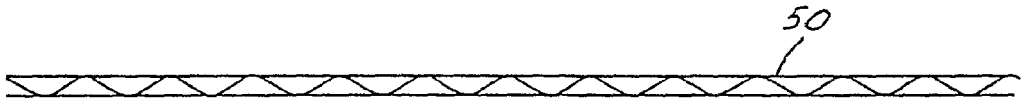
FIG. 11 is an enlarged view taken on line 11—11 of FIG. 10.

After the cassettes 12 are connected to each other as explained above, a flat round plate 46 (as seen in FIG. 2) without port holes is attached to the bottom of the cassette pack by a weld which forms a seal along the outer perimeter of the plate 46. This is followed by similarly welding a flat round plate 48 to the top of the cassette pack. In this regard, it will be noted that the plate 48 is provided with round holes which register with the inlet and outlet ports 22 and 24 of the cassettes 12. A disk 50 having circular corrugations, as seen in FIGS. 10 and 11, is then attached at its center by a weld to the bottom surface of plate 46. Afterwards, the seals 32 are fixedly attached to the edges of the cassette pack. Once this core portion of the heat exchanger 10 is fabricated, it is placed within the heat exchanger housing as seen in FIG. 1. During use of the heat exchanger 10, the disk 50 serves as a spring device to compensate for any vertical expansion of the cassettes 12 that may occur during the operation of the heat exchanger 10. More specifically, the disk 50 is made of spring steel and is seated against the bottom cover member 18 so as to assist with plate pack thermal expansion by absorbing axial plate pack movement along the perpendicular direction to the bottom cover member 18. In other words, the disk 50 acts as a bellows or spring, and allows the plate pack to expand towards and away from the bottom cover member 18. This arrangement reduces fatigue stresses that would otherwise occur if the plates of the cassettes 12 were forced to remain in place during periods of temperature fluctuations and associated thermal expansions.

Figure 12:
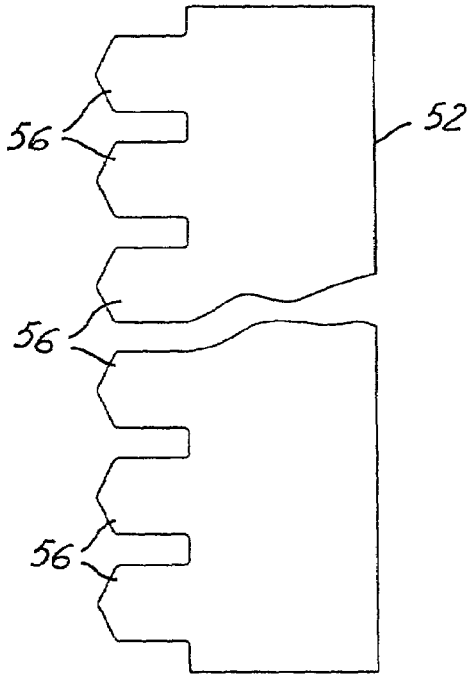
FIG. 12 is an enlarged side view of part of the metal seal shown in FIG. 4.

As seen in FIGS. 3, 4 and 12, each of the seals 32 is made of metal and comprises a metal bar 52 and a pair of identical metal clips 54 as shown in FIG. 12. The bar 52 has one edge thereof provided with uniformly vertically spaced contoured projections 56. Each of the projections 56 has the same shape as the spaces 58 seen in FIG. 9 that are located adjacent the periphery of each of the cassettes 12. The projections 56 of the bar 52 fit tightly into the outer peripheral spaces 58 between the HT plates 38 and 38*a* of the stacked cassettes 12. The metal clips 54 are made of spring steel and are welded to the plates 46 and 48 to assist in sealing the chambers 34 and 36 from each other and in holding the bar 52 in place. As seen in FIG. 4, the clips 54 are "J" shaped in cross section and, although not shown, extend vertically the length of the cassette stack between the plates 46 and 48. A curved portion 60 of each of the clips 54 continually biases the inner curved surface of the shell 14 and together with the bar 52 provides the seal between the chambers 34 and 36.

Figure 13:
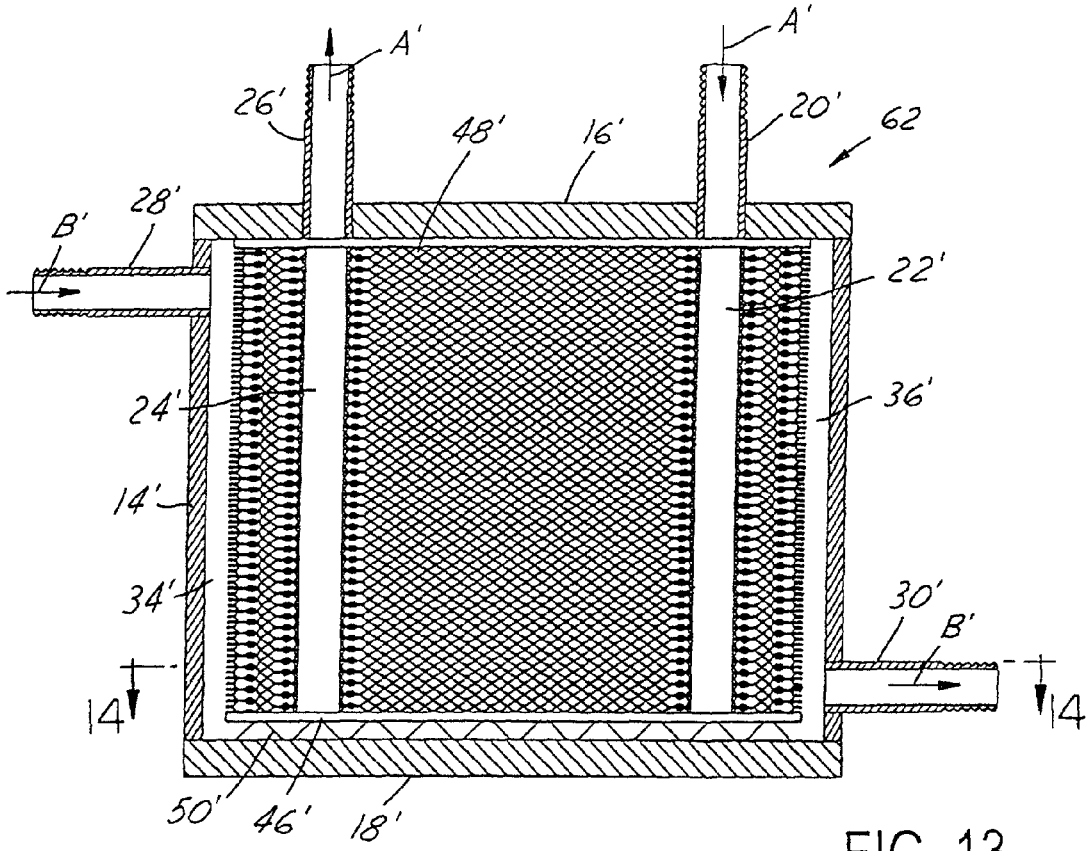
FIG. 13 is a sectional view of another version of the heat exchanger seen in FIGS. 1–12.
Figure 14:
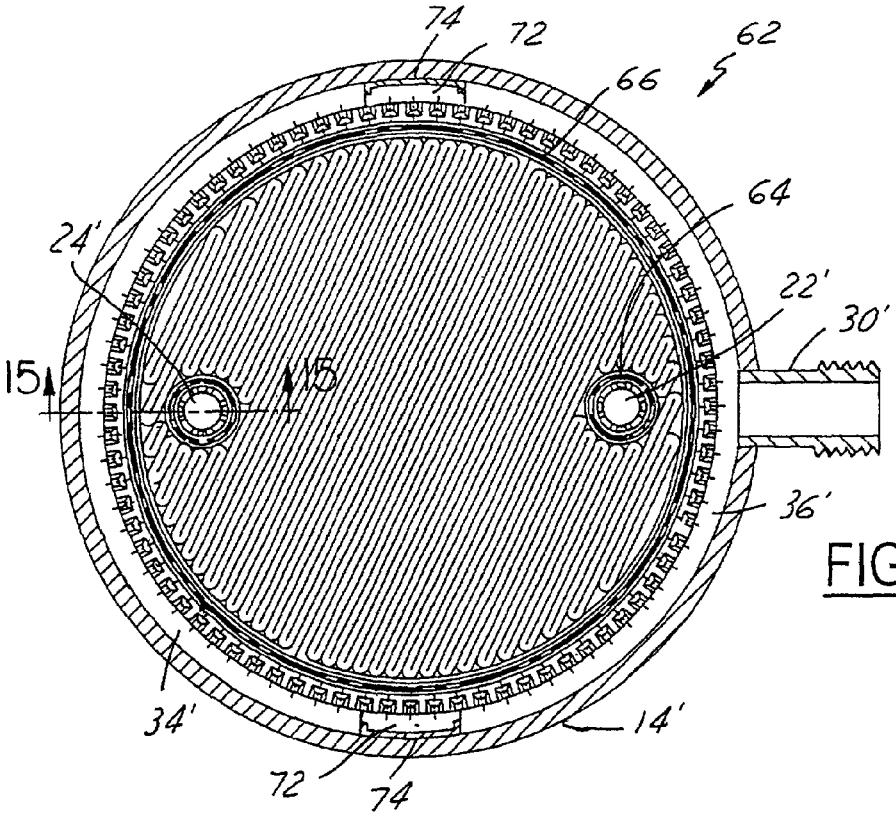
FIG. 14 is a top sectional view taken on line 14—14 of FIG. 13.
Figure 15:
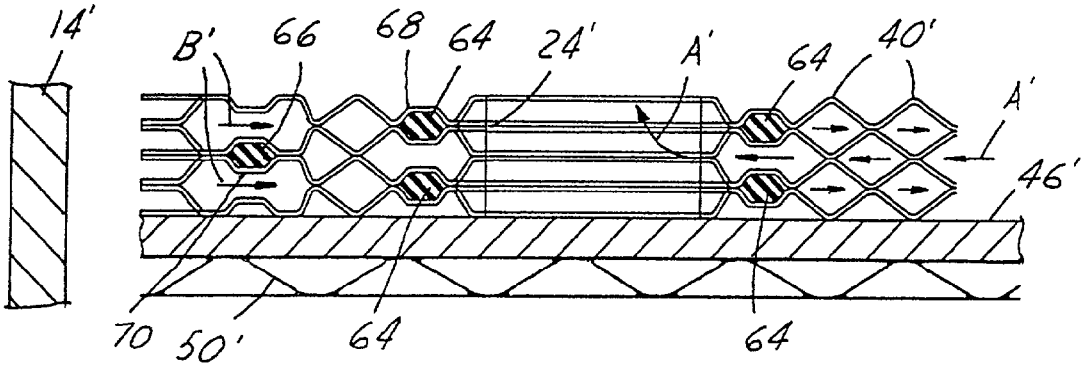
FIG. 15 is an enlarged sectional view taken on lines 15—15 of FIG. 14.

FIGS. 13–15 show another version of the heat exchanger made according to the present invention. It will be understood that the parts of the heat exchanger 62 shown in FIGS. 13–15 that are essentially identical to those parts of the heat exchanger 10 seen in FIGS. 1–12 are identified by the same reference numerals but primed.

As seen in FIGS. 13–15, the heat exchanger 62 shown includes a plurality of HT plates having certain structural similarities to the HT plates 38 and 38*a*. In this instance, however, the HT plates of the heat exchanger 62 are stacked one over the other and have elastomeric circular O-ring type gaskets 64 and 66 located between such HT plates to provide for vertically spaced channels through which the primary and secondary fluids can flow. As with the HT plates 38 and 38*a* of the cassettes 12, the HT plates of this heat exchanger 62 are arranged so that the channels of adjacent HT plates cross each other. Moreover, rather than providing a weld around the port holes to join a pair of adjacent HT plates and providing a weld at the perimeter to join adjacent cassettes as in the case of heat exchanger 10, the sealing of the HT plates of this heat exchanger 62 is provided by the gaskets 64 and 66 on opposite sides of an individual HT plate. Thus, a circular gasket 64 in the form of an O-ring is located within a circular depression or track 68 surrounding each of the inlet and outlet ports 22' and 24'. Accordingly, rather than have a weld such as weld 42 around the inlet and outlet ports 22 and 24 of cassettes 12 of heat exchanger 10, the O-ring 64 serves the same purpose.

Similarly, rather than have the weld 44 for joining two adjacent cassettes 12 as seen in FIG. 9, the enlarged O-ring type seal 66 is located in a circular depression or track 70 located adjacent to the outer peripheral edge of each of the HT plates of the heat exchanger 62. In this manner the primary fluid indicated by the arrows A' in FIG. 15 is separated from the secondary fluid indicated by the arrows B'. It will be understood that one or the other of the gaskets 64 or 66 can be eliminated and substituted by a weld so as to provide a semi-welded heat exchanger rather than a fully gasketed heat exchanger as shown in FIGS. 13–15.

Also note that the heat exchanger 62 of FIGS. 13–15 is provided with diametrically opposed identical seals for preventing direct fluid flow between the nozzles 28' and 30'. The seals, as seen in FIG. 14, take the form of an elastomeric pad 72 contoured with projections (not shown) to fit into the spaces between the HT plates in the manner of the bar 52 provided in the heat exchanger 10 of FIGS. 1–12. Each of the pads 72 is held securely in place by compression imparted by a metal support bar 74 having a cross-sectional curved shape corresponding to the curvature of the inner side of the shell 14'.

The arrangement of the HT plates in the heat exchanger 62 of FIGS. 13–15 is ideal when there are two fouling fluids in service and when it is desirable to clean the entire unit. Also note that during HT plate pack assembly, there is a possibility that, unless held in their accommodating tracks, the gaskets 64 and 66 could fall or slip out of place. To this end, an adhesive is used, that can be easily cleaned off and removed, to attach the gaskets 64 and 66 into their respective depressions or tracks. Once compressed by the HT plates, the gaskets 64 and 66 form a tight seal between channels that is independent of the adhesive.

Figure 17:
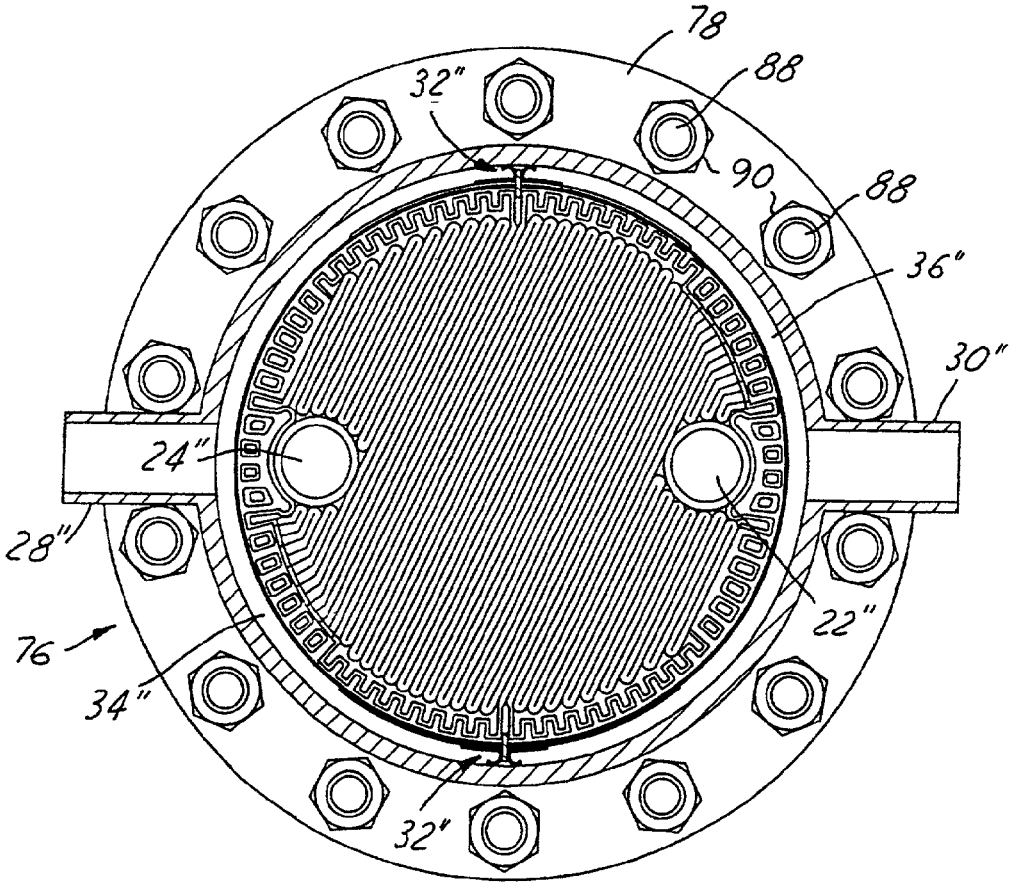
FIG. 17 is a reduced sectional view taken on line 17—17 of FIG. 16.
Figure 16:
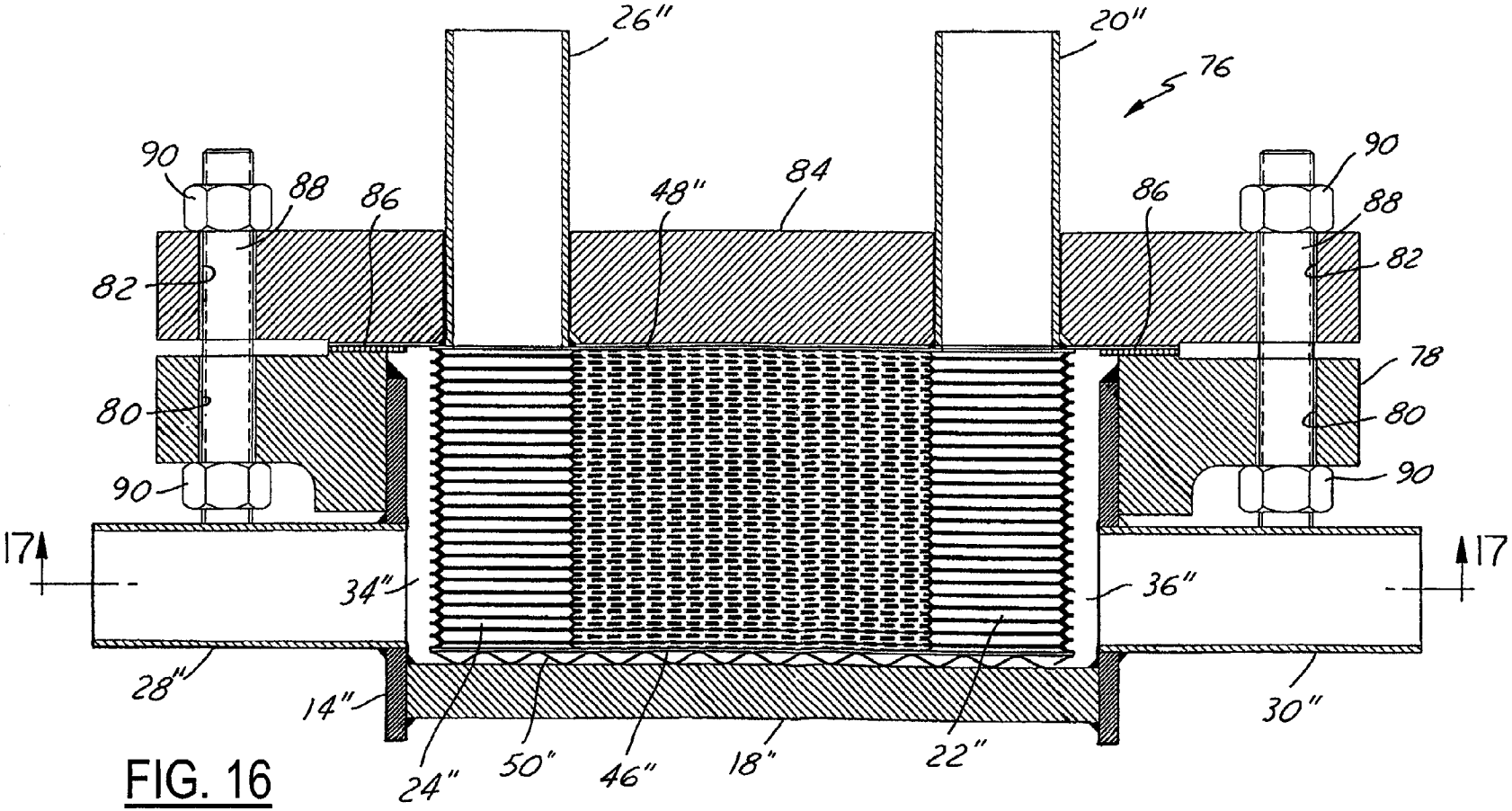
FIG. 16 is a sectional view of still another version of the heat exchanger according to the present invention.

FIGS. 16 and 17 show another version of a heat exchanger shown in FIGS. 1–12. It will be noted that, in this instance, the parts of this heat exchanger 76 seen in FIGS. 16 and 17 that are essentially the same as those parts shown in FIGS. 1–12 will be identified by the same reference numerals but double primed.

As seen in FIGS. 16 and 17, a cylindrical shell 14" with bottom cover member 18" forms the welded portion of the housing assembly. At the upper end of the shell 14", a ring type flange 78 is fixedly secured by a weld to the shell 14". The flange 78 is provided with a plurality of circumferentially equally spaced holes 80 which register with corresponding holes 82 formed in a round top cover member 84. A circular gasket 86 is provided to affect the seal between top member 84 and the flange 78, and the bolting illustrated is provided by threaded studs 88 and nuts 90. This alternative shell assembly arrangement seen in FIGS. 16–18 enables the HT plate pack to be removed from the housing for disassembly and cleaning without the need to remove and subsequently replace welds as is the case with the cylindrical shell 14 and the top cover member 16 shown in the all welded design of the heat exchanger 10 of FIGS. 1–12. The top round plate 48" provides a flat surface to which the inlet and outlet port nozzles 20" and 26" can be attached by welding or other convenient means. The bottom round plate 46" provides a rigid surface for support of the plate pack against point loads that might be imposed by the disk 50".

Various modifications and changes can be made to the heat exchanger constructions without departing from the spirit of the invention. Such changes and modifications are contemplated by the inventor and he does not wish to be limited except by the scope of the appended claims.

We claim:

1. A heat exchanger comprising a housing including a cylindrical shell closed by a top cover member and a bottom cover member, a plurality of first heat transfer plates and a plurality of second heat transfer plates located within said cylindrical shell with said first heat transfer plates interleaved with said second heat transfer plates in alternating relationship in a plate stack and with spaces between said first and second heat transfer plates, each of said first and second heat transfer plates being formed with channels on opposite sides of said each of said heat transfer plates that provide first and second fluid passages for fluid flow between the heat transfer plates, said first fluid passages for a first fluid in alternate spaces and said second fluid passages for a second fluid in remaining spaces, and a spring device located in said housing adjacent one end of said plate stack, said spring device supporting said plate stack and compensating for any expansion or contraction of said heat transfer plates along the longitudinal axis of the housing during operation of said heat exchanger.

2. The heat exchanger of claim 1 wherein said first and second heat transfer plates are formed with an inlet port and an outlet port in the body of said first and second heat transfer plates for fluid connection with said first fluid passages.

3. The heat exchanger of claim 2 wherein said cylindrical shell is formed with a first inlet nozzle for feeding said second fluid to said second fluid passages and said cylindrical shell also being formed with a first outlet nozzle diametrically opposed to said first inlet nozzle for permitting said second fluid to exit said heat exchanger.

4. The heat exchanger of claim 3 wherein the periphery of said first and second heat transfer plates is uniformly spaced from the inner surface of said cylindrical shell so as to provide a chamber that is divided by a pair of diametrically opposed seals positioned within said chamber into an arcuate inlet chamber connected to said first inlet nozzle and an arcuate outlet chamber connected to said first outlet nozzle.

5. The heat exchanger of claim 4 wherein said pair of seals are positioned within said chamber along an axis which is substantially normal to an axis passing through the centers of said first inlet nozzle and said first outlet nozzle.

6. The heat exchanger of claim 4 wherein each of said seals comprises an elastomeric pad held securely in place by compression imparted by a metal support bar having a curved cross-sectional configuration conforming to the inner surface of said cylindrical shell.

7. The heat exchanger of claim 4 wherein said top cover member is formed with a second inlet nozzle and a second outlet nozzle whereby said second inlet nozzle feeds said first fluid to said inlet port and said second outlet nozzle permits said first fluid to exit said heat exchanger after flowing through said first fluid passages.

8. The heat exchanger of claim 5 wherein said cylindrical shell is formed with a circular flange and said top cover member is adapted to be bolted to said flange.

9. The heat exchanger of claim 5 wherein said spring device includes a disk formed with circular corrugations.

10. A heat exchanger comprising a housing including a cylindrical shell closed by a top cover member and a bottom cover member, a plurality of first heat transfer plates and a plurality of second heat transfer plates located within said cylindrical shell with said first heat transfer plates interleaved with said second heat transfer plates in alternating relationship in a plate stack and with spaces between said first and second heat transfer plates, each of said first and second heat transfer plates being formed with channels on opposite sides of said each of said heat transfer plates that provide first and second fluid passages for fluid flow between the heat transfer plates, said first fluid passages for a first fluid in alternate spaces and said second fluid passages for a second fluid in remaining spaces, and a corrugated member made of spring steel located in said housing adjacent one of said cover members and serving to compensate for any expansion or contraction of said heat transfer plates along the longitudinal axis of the housing during operation of said heat exchanger, wherein said first and second heat transfer plates are formed with an inlet port and an outlet port in the body of said first and second heat transfer plates for fluid connection with said first fluid passages, said cylindrical shell is formed with a first inlet nozzle for feeding said second fluid to said second fluid passages and said cylindrical shell also being formed with a first outlet nozzle diametrically opposed to said first inlet nozzle for permitting said second fluid to exit said heat exchanger, the periphery of said first and second heat transfer plates is uniformly spaced from the inner surface of said cylindrical shell so as to provide a chamber that is divided by a pair of diametrically opposed seals positioned within said chamber into an arcuate inlet chamber connected to said first inlet nozzle and an arcuate outlet chamber connected to said first outlet nozzle, said pair of seals are positioned within said chamber along an axis which is substantially normal to an axis passing through the centers of said first inlet nozzle and said first outlet nozzle, and each of said pair of seals comprises a metal bar and a pair of identical metal clips.

11. The heat exchanger of claim 10 wherein said bar has one edge thereof provided with uniformly vertically spaced projections that fit into outer peripheral spaces formed by the heat transfer plates of each of said cassettes.

12. The heat exchanger of claim 11 wherein said metal clips are J-shaped in cross section and are located on opposed sides of said bar.

13. A heat exchanger comprising:

a housing including a cylindrical shell closed by a top cover member and a bottom cover member, a plurality of first heat transfer plates and a plurality of second heat transfer plates located within said cylindrical shell with said first heat transfer plates interleaved with said second heat transfer plates in alternating relationship to provide a plate stack, and with spaces between said first and second heat transfer plates, each of said first and second heat transfer plates being formed with channels on opposite sides of said each of said heat transfer plates that provide first and second fluid passages for fluid flow between the heat transfer plates, said first fluid passages for a first fluid in alternate spaces and said second fluid passages for a second fluid in remaining spaces, said housing having a housing inlet for feeding the first fluid into said first fluid passages and having a housing outlet for permitting the first fluid to exit the heat exchanger, the periphery of said first and second heat transfer plates being spaced from the inner surfaces of said cylindrical shell so as to provide an inlet chamber and an outlet chamber, said cylindrical shell having a shell inlet for feeding said second fluid into said inlet chamber and from said inlet chamber into said second fluid passages, said cylindrical shell having a shell outlet for permitting the second fluid to pass from the second fluid passages through the outlet chamber and exit said heat exchanger from said shell outlet, and further including a circular area surrounding said plates and also including seals within said circular area, said seals dividing said circular area to separate said inlet and outlet chambers.

14. The heat exchanger of claim 13 wherein said first and second heat transfer plates are formed with inlet ports and outlet ports in the body of said first and second heat transfer plates, said housing inlet being connected to said inlet ports and said housing outlet being connected to said outlet ports.

15. The heat exchanger of claim 14 wherein said plurality of first heat transfer plates and said plurality of second heat transfer plates form a series of cassettes stacked on top of each other.

16. The heat exchanger of claim 15 wherein each of said cassettes comprises a first heat transfer plate and an identical second transfer plate which has been rotated 180 degrees and turned over and superimposed upon said first heat transfer plate.

17. The heat exchanger of claim 16 wherein each of said first and second heat transfer plates is formed with a plurality of parallel corrugations which are V-shaped in cross-section.

18. The heat exchanger of claim 17 wherein said corrugations of said first heat transfer plate and said corrugations of said second heat transfer plate of each of said cassettes are at a fixed angle relative to each other.

19. The heat exchanger of claim 18 further including a spring device located in said housing adjacent one end of said plate stack, said spring device supporting said plate stack and compensating for any expansion or contraction of the plate stack along the longitudinal axis of the housing during operation of the heat exchanger.

* * * * *